US006857723B2

(12) United States Patent
DeBoard et al.

(10) Patent No.: US 6,857,723 B2
(45) Date of Patent: Feb. 22, 2005

(54) METHOD, PRINTER AND PRINTHEAD DRIVER FOR PRINTING USING TWO PRINTHEADS

(75) Inventors: Bruce A. DeBoard, Lexington, KY (US); John A. Goodman, Shelbyville, KY (US); Tommy O. Lowe, Lexington, KY (US); Joseph W. Luciano, Lexington, KY (US); Bryan D. McKinley, Lexington, KY (US); Daniel S. Powell, Versailles, KY (US); Thomas J. Eade, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 25 days.

(21) Appl. No.: 10/419,177

(22) Filed: Apr. 18, 2003

(65) Prior Publication Data

US 2004/0207686 A1 Oct. 21, 2004

(51) Int. Cl.[7] ..... B41J 2/145; B41J 2/15
(52) U.S. Cl. ..... 347/41
(58) Field of Search ..... 347/41, 9, 12, 347/40

(56) References Cited

U.S. PATENT DOCUMENTS

| | | | | |
|---|---|---|---|---|
| 4,916,638 | A | 4/1990 | Haselby et al. | |
| 4,953,995 | A | 9/1990 | Sims et al. | |
| 5,297,017 | A | 3/1994 | Haselby et al. | |
| 5,724,086 | A | 3/1998 | Mackin et al. | |
| 5,774,144 | A * | 6/1998 | Eriksen | 347/41 |
| 5,805,183 | A | 9/1998 | Lidke et al. | |
| 5,808,655 | A | 9/1998 | Haas et al. | |
| 5,867,183 | A | 2/1999 | Cornell et al. | |
| 6,000,782 | A | 12/1999 | Lee | |
| 6,234,606 | B1 | 5/2001 | Suzuki | |
| 6,297,888 | B1 | 10/2001 | Noyes et al. | |
| 6,299,284 | B1 | 10/2001 | Alfaro | |
| 6,315,387 | B1 | 11/2001 | Horikoshi | |
| 6,328,400 | B1 | 12/2001 | Yonekubo et al. | |
| 6,425,653 | B1 | 7/2002 | Bloomberg | |
| 6,450,605 | B1 | 9/2002 | Walmsley et al. | |
| 6,464,330 | B1 | 10/2002 | Miller et al. | |
| 6,471,332 | B1 | 10/2002 | Vilanova et al. | |
| 6,488,351 | B1 | 12/2002 | Newkirk et al. | |
| 6,523,937 | B1 * | 2/2003 | Payne | 347/43 |
| 2002/0017597 | A1 | 2/2002 | Otsuki | |
| 2002/0163550 | A1 | 11/2002 | Otsuki | |
| 2002/0175962 | A1 | 11/2002 | Otsuki | |

FOREIGN PATENT DOCUMENTS

| | | |
|---|---|---|
| EP | 0953451 A2 | 3/1999 |

* cited by examiner

*Primary Examiner*—Thinh Nguyen
(74) *Attorney, Agent, or Firm*—Thompson Hine LLP

(57) ABSTRACT

A first method obtains a printer having a single-printhead horizontal resolution of H dpi. Dots are printed using first and second printheads in the same print pass. The first printhead is enabled and the second printhead is non-enabled during a first portion of a carrier-movement distance equal to 1/H, and the second printhead is enabled and the first printhead is non-enabled during a second non-overlapping portion of such distance. A printer and a printhead driver for performing the first method are described. A second method obtains a printer having a single-printhead resolution of H horizontal dpi by V vertical dpi. First print data for the first printhead and second print data for the second printhead of H/2 horizontal dpi by V vertical dpi are obtained, are horizontally interlaced creating H horizontal dpi by V vertical dpi, and are printed using the first and second printheads in the same print pass.

29 Claims, 4 Drawing Sheets

| | | | | | | | | | | | |
|---|---|---|---|---|---|---|---|---|---|---|---|
| 1 | 2 | 1 | 2 | 1 | 2 | 1 | 2 | 1 | 2 | 1 | 2 |
| 1 | 2 | 1 | 2 | 1 | 2 | 1 | 2 | 1 | 2 | 1 | 2 |
| 1 | 2 | 1 | 2 | 1 | 2 | 1 | 2 | 1 | 2 | 1 | 2 |
| 1 | 2 | 1 | 2 | 1 | 2 | 1 | 2 | 1 | 2 | 1 | 2 |

FIG. 8

| | | | | | | | | | | | |
|---|---|---|---|---|---|---|---|---|---|---|---|
| 1-1 | 3-2 | 1-2 | 3-1 | 1-1 | 3-2 | 1-2 | 3-1 | 1-1 | 3-2 | 1-2 | 3-1 |
| 2-2 | 4-1 | 2-1 | 4-2 | 2-2 | 4-1 | 2-1 | 4-2 | 2-2 | 4-1 | 2-1 | 4-2 |
| 1-1 | 3-2 | 1-2 | 3-1 | 1-1 | 3-2 | 1-2 | 3-1 | 1-1 | 3-2 | 1-2 | 3-1 |
| 2-2 | 4-1 | 2-1 | 4-2 | 2-2 | 4-1 | 2-1 | 4-2 | 2-2 | 4-1 | 2-1 | 4-2 |

FIG. 9

METHOD, PRINTER AND PRINTHEAD DRIVER FOR PRINTING USING TWO PRINTHEADS

TECHNICAL FIELD

The present invention relates generally to printing, and more particularly to a method for printing using two printheads, to a printer for printing using two printheads, and to a printhead driver for printing using two printheads.

BACKGROUND OF THE INVENTION

Printers include, without limitation, computer printers, copiers, and facsimile machines. Some printers, such as inkjet printers, print by printing closely-spaced ink dots on a print medium such as paper. Conventional inkjet printers include those having a carrier with two (or more) printheads such as a color printhead and a mono or a photo printhead. Typically, a color printhead prints cyan, magenta and yellow dots, a mono printhead prints black dots, and a photo printhead prints black, cyan and magenta dots. Typically, to print a print swath requiring use of the two printheads, the carrier moves across the paper in a first print pass (or multiple print passes without advancing the paper) with the first printhead under the command of a printhead driver. Then, without advancing the paper, the carrier again moves across the paper in a second print pass (or multiple print passes without advancing the paper) while printing with the second printhead under the command of the same printhead driver. Conventionally, faster printing using two printheads during the same print pass of the carrier across the paper required two printhead drivers and double the memory which significantly added to the cost of the printer.

What is needed is an improved method, an improved printer, and/or an improved printhead driver for printing using two printheads.

SUMMARY OF THE INVENTION

A first method of the invention is for printing dots on a print medium in a first printing mode using first and second printheads as a carrier moves horizontally across the print medium in the same print pass. During a first portion of a carrier-movement distance equal to 1/H, wherein H comprises a horizontal resolution of the printer in horizontally-spaced apart dots-per-inch using one of the printheads, the first printhead is enabled and the second printhead is not enabled. During a second portion of the carrier-movement distance, the second printhead is enabled and the first printhead is not enabled. The first and second portions do not overlap.

A first expression of an embodiment of the invention is for a printer including a carrier, first and second printheads, and a printhead driver. The carrier is horizontally movable across a print medium. The first and second printheads are attached to the carrier. The printhead driver is connected to the first and second printheads. The printer has a horizontal resolution using a single printhead of H horizontally-spaced-apart dots-per-inch. The printhead driver has a first printing mode which enables the first printhead and non-enables the second printhead during a first portion of a carrier-movement distance equal to 1/H and which enables the second printhead and non-enables the first printhead during a second portion of the carrier-movement distance. The first and second portions do not overlap.

A second expression of an embodiment of the invention is for a printhead driver. The printhead driver includes first, second and third printhead select pins. The printhead driver also includes printer-driver logic which creates an enable or a non-enable signal on each of the first, second and third printhead select pins. The printhead driver additionally includes a printhead connect line. The first printhead select pin is connectable to a first printhead of a movable carrier. The second and third printhead select pins are coupled to the printhead connect line in a logical OR connection. The printhead connect line is connectable to a second printhead of the carrier.

A second method of the invention is for printing using a printer having a carrier which is horizontally movable across a print medium and having two horizontally-spaced-apart printheads attached to the carrier, wherein the printer has a resolution using one of the printheads of H horizontally-spaced-apart dots-per-inch by V vertically-spaced-apart dots-per-inch. First print data is obtained for the first printhead of H/2 horizontally-spaced-apart dots-per-inch by V vertically-spaced-apart dots-per-inch. Second print data is obtained for the second printhead of H/2 horizontally-spaced-apart dots-per-inch by V vertically-spaced-apart dots-per-inch. The first and second print data are horizontally interlaced to create interlaced print data of H horizontally-spaced-apart dots-per-inch by V vertically-spaced-apart dots-per-inch. Dots are printed on the print medium corresponding to the interlaced print data using the first and second printheads as the carrier moves horizontally across the print medium in the same print pass.

Several benefits and advantages are derived from one or more of the methods and the expressions of an embodiment of the invention. Printing using two printheads in the same print pass can be accomplished by the first method and by the second method using a single printhead driver with less memory, lower power, and lower cost compared to conventional methods which require using two printhead drivers.

BRIEF DESCRIPTION OF THE DRAWINGS

FIG. 8 is an illustration of an example of dots printed on a print medium by a single-pass print swath using the second method of FIG. 7, and FIG. 9 is an illustration of an example of dots printed on a print medium by a four-pass print swath using the second method of FIG. 7.

DETAILED DESCRIPTION

Figure 1:
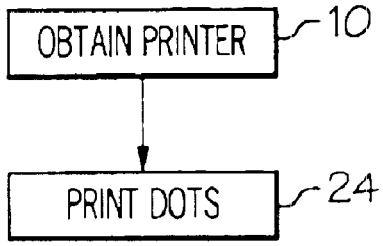
FIG. 1 is a flow chart of a first method for printing.

Referring to FIGS. 1–6, a first method of the invention is for printing and includes steps a) and b). Step a) is labeled as "Obtain Printer" in block 10 of FIG. 1. Step a) includes obtaining a printer 12 having a carrier 14 which is horizontally movable across a print medium 16, having first and second printheads 18 and 20 attached to the carrier 14, and having a printhead driver 22 connected to the first and second printheads 18 and 20, wherein the printer 12 has a horizontal resolution using a single printhead of H horizontally-spaced-apart dots-per-inch. Step b) is labeled as "Print Dots" in block 24 of FIG. 1. Step b) includes printing dots 26 on the print medium 16 in a first printing mode using the first and second printheads 18 and 20 as the carrier 14 moves horizontally across the print medium 16 in the same print pass, wherein the first printhead 18 is enabled and the second printhead 20 is non-enabled by the printhead driver 22 during a first portion 28 of a carrier-movement distance 30 equal to 1/H, wherein the second printhead 20 is enabled and the first printhead 18 is non-enabled by the printhead driver 22 during a second portion 32 of the carrier-movement distance 30, and wherein the first and second portions 28 and 32 do not overlap. In one variation, step b) is repeated for each additional carrier-movement distance 30 covered by the carrier 14 as the carrier 14 moves horizontally across the print medium 16 in a single-pass print swath or in one pass of a multi-pass print swath.

The term "printer" includes, without limitation, computer printers, copiers, and facsimile machines. The term "horizontal" (and later the term "vertical") is used only as a term of convenience for ease of description because printer resolution is described in the art as H×V dpi (dots per inch) where H is the number of horizontal dots per inch and V is the number of vertical dots per inch or printer resolution is described as X dpi where X is the number of dots per inch of horizontal resolution and vertical resolution. It is noted that describing the carrier 14 as moving "horizontally" across the print medium 16 includes the carrier 14 moving along its scan axis across the print medium even if the scan axis is not geometrically horizontal. It also is noted that H depends on the carrier speed and the time required for the same inkjet nozzle (if an inkjet printer is used) of the same printhead to fire twice and that V depends on the vertical distance between printhead inkjet nozzles (if an inkjet printer is used) of the same printhead.

Figure 2:
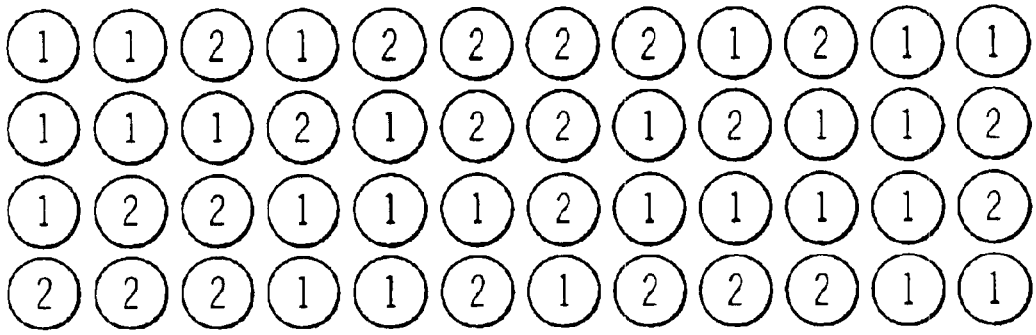
FIG. 2 is an illustration of an example of dots printed on a print medium by a single-pass print swath using the first method of FIG. 1.

In a first example of the first method of FIG. 1, H equals 600 dots per inch. In one variation, the first portion 28 is the first 1/1200 of an inch of a carrier movement distance 30 of 1/600 of an inch, and the second portion 32 is the second 1/1200 of an inch of a carrier movement distance 30 of 1/600 of an inch. In one modification, the printer has a vertical resolution of 600 dots per inch. FIG. 2 is an example of dots 26 printed on a print medium 16 in a single print pass of the carrier 14, wherein the printer has a horizontal resolution of 600 dpi and a vertical resolution of 600 dpi. FIG. 2 depicts the dots 26 as circles which contain the number "1" if printed by the first printhead 18 and which contain the number "2" if printed by the second printhead 20. Only dots 26 printed by the top four inkjet nozzles (also called just nozzles) 33 of each printhead 18 and 20 (assuming the printheads are ink-jet printheads) are shown in FIG. 2. The term "printed" used in describing FIG. 2 includes inked dots and blank dots, as is understood by the artisan. The number "1" or "2" appears in a dot 26 according to the particular print data to be printed. Examples of other printer resolutions and other first and second portions 28 and 32 are left to the artisan.

In a first extension of the first method of FIG. 1, there is also included step c) of printing additional dots (not shown) in a second printing mode using only the first printhead, wherein the second printhead is non-enabled by the printhead driver during the entire carrier-movement distance. In one variation, step c) prints dots in the second printing mode as the carrier moves across the print medium in a second print pass, and there is further included the step of advancing the print medium between step b) and step c). In one modification, there is also included the step of printing other dots (not shown) in a third printing mode using only the second printhead, wherein the first printhead is non-enabled by the printhead driver during the entire carrier-movement distance. Other extensions (including extending the first method to print with three or more printheads in the same print pass), other variations, (including printing in two or more printing modes in the same print pass) and other modifications of the first method are left to those skilled in the art.

In one enablement of the first method, the first printhead 18 is an ink-jet color printhead, and the second printhead 20 is an inkjet mono printhead or an ink-jet photo printhead. In one variation, the color printhead prints cyan dots, magenta dots and yellow dots, the mono printhead prints black dots, and the photo printhead prints black dots, cyan dots and magenta dots. Examples of using other types of printers, other types of printheads (including using two identical printheads such as two mono printheads), and other colors are left to the artisan.

Figure 3:
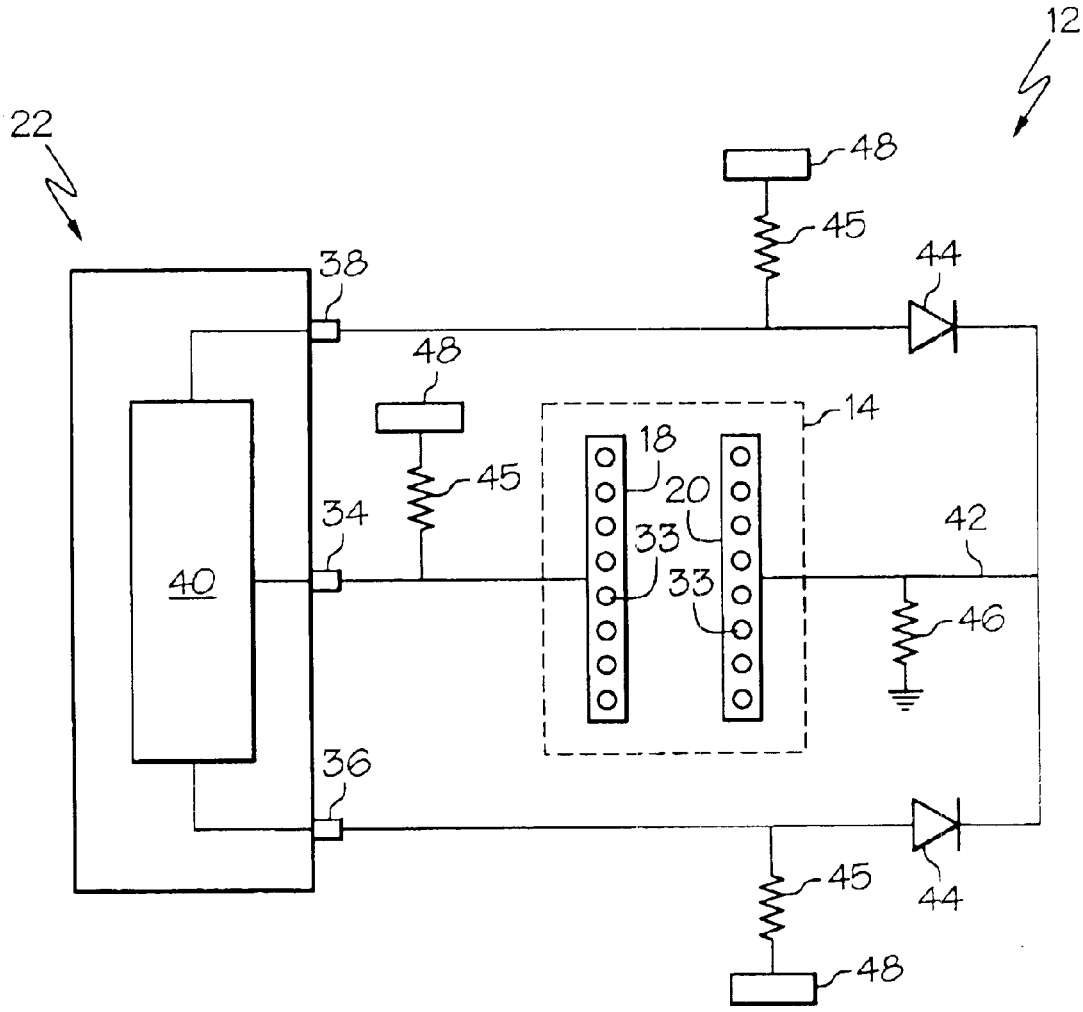
FIG. 3 is a schematic circuit diagram of one embodiment of a printer including a printhead driver for carrying out the method of FIG. 1.

A first expression of an embodiment of the invention, shown in FIG. 3, is for a printer 12. The printer 12 includes a carrier 14, first and second printheads 18 and 20, and a printhead driver 22. The carrier 12 is horizontally movable across a print medium 16. The first and second printheads 18 and 20 are attached to the carrier 14. The printhead driver 22 is connected to the first and second printheads 18 and 20. The printer 12 has a horizontal resolution using a single printhead of H horizontally-spaced-apart dots-per-inch. The printhead driver 22 has a first printing mode which enables the first printhead 18 and non-enables the second printhead 20 during a first portion 28 of a carrier-movement distance 30 equal to 1/H and which enables the second printhead 20 and non-enables the first printhead 18 during a second portion 32 of the carrier-movement distance 30, wherein the first and second portions 28 and 32 do not overlap.

In a first example of the first expression of the embodiment of FIG. 3, the printhead driver 22 also has a second printing mode which enables the first printhead 18 during the carrier-movement distance 30 (i.e., during at least a part of the carrier-movement distance 30) and which non-enables the second printhead 20 during the entire carrier-movement distance 30. In one variation, the printhead driver 22 also has a third printing mode which enables the second printhead 20 during the carrier-movement distance 30 (i.e., during at least a part of the carrier-movement distance 30) and which non-enables the first printhead 18 during the entire carrier-movement distance 30.

In the same or a different example of the first expression, the printhead driver 22 includes first, second and third printhead select pins 34, 36 and 38, wherein the first printhead select pin 34 is connected to the first printhead 18, and wherein the second and third printhead select pins 36 and 38 are coupled to the second printhead 20 in a logical OR connection. In one modification, in the first printing mode the printhead driver 22 always creates a non-enable signal on the third printhead select pin 38, and in the second and third printing modes the printhead driver 22 always creates a non-enable signal on the second printhead select pin 36.

In one construction of the first expression, the first printhead 18 is an inkjet color printhead, and the second printhead 20 is an inkjet mono printhead or an inkjet photo printhead. In one modification, the color printhead prints cyan dots, magenta dots and yellow dots, the mono printhead prints black dots, and the photo printhead prints black dots, cyan dots and magenta dots.

A second expression of the embodiment of FIG. 3 is for a printhead driver 22. The printhead driver 22 includes first, second and third printhead select pins 34, 36 and 38. The printhead driver 22 also includes printer-driver logic 40 which creates an enable or a non-enable signal on each of the first, second and third printhead select pins 34, 36 and 38. The printhead driver 22 additionally includes a printhead connect line 42. The first printhead select pin 34 is connectable to a first printhead 18 of a movable carrier 14, and the second and third printhead select pins 36 and 38 are coupled to the printhead connect line 42 in a logical OR connection. The printhead connect line 42 is connectable to a second printhead 20 of the carrier 14.

In one construction of the second expression, the logical OR connection uses diodes 44 as shown in FIG. 3. In this construction, resistors 45 are pull-down resistors and the resistor 46 ensures second printhead 20 non-enablement when a non-enablement signal is present on both the second and third printhead select pins 36 and 38, as can be appreciated by those skilled in the art. Also, a printhead voltage 48 is applied as shown in FIG. 3.

Figure 4:
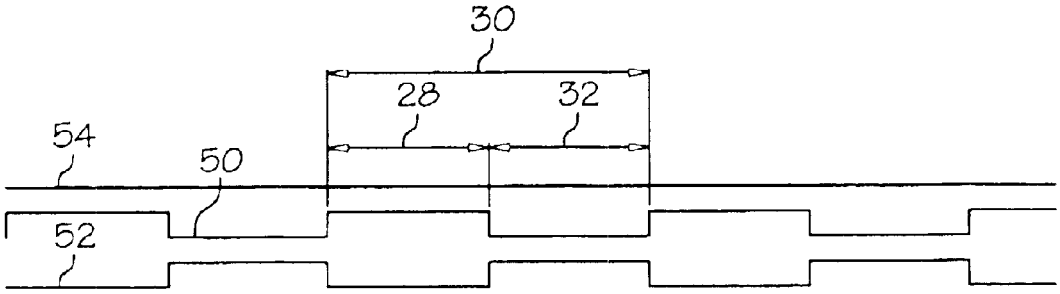
FIG. 4 is a signal timing chart of an example of the first method of FIG. 1 using the printer of FIG. 3 when printing using two printheads in the same print pass.
Figure 5:
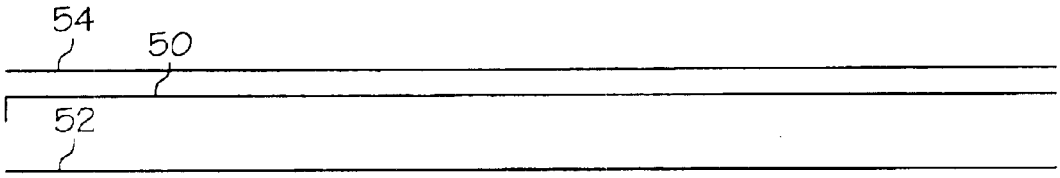
FIG. 5 is the signal timing chart of FIG. 3 when printing using only the first printhead in a print pass.
Figure 6:
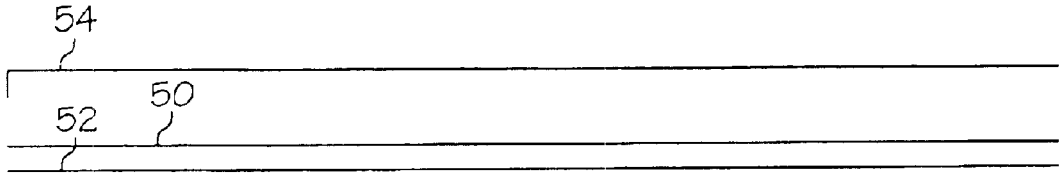
FIG. 6 is the signal timing chart of FIG. 3 when printing using only the second printhead in a print pass.

FIG. 4 shows an example of the first signal 50 of the first printhead select pin 34, the second signal 52 of the second printhead select pin 36 and the third signal 54 on the third printhead select pin 38 for the first printing mode wherein a high value of a signal is an enable signal and a low value of a signal is a non-enable signal. It is noted that in this example the third signal 54 on the third printhead select pin 38 is a non-enable signal in the first print mode and that the first and second signals 50 and 52 have opposite states and change states based on a predetermined number of clock counts (e.g., the fall of the fourteenth clock pulse) of a clock that controls the count of the address lines or based on a predetermined number of distance counts of the position encoder of the carrier. FIG. 5 shows an example of the first, second and third signals 50, 52 and 54 in the second print mode. It is noted that in this example the first signal 50 is an enable signal and the second and third signals 52 and 54 are non-enable signals in the second print mode. FIG. 6 shows an example of the first, second and third signals 50, 52 and 54 in the third print mode. It is noted that in this example the third signal 54 is an enable signal and the first and second signals 50 and 52 are non-enable signals in the third print mode.

Figure 7:
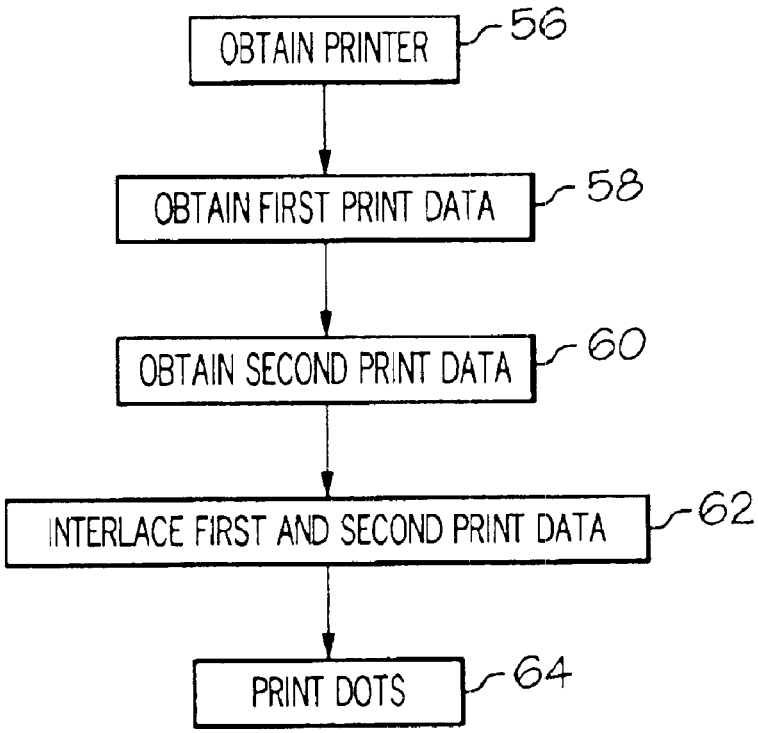
FIG. 7 is a flow chart of a second method for printing.

Referring to FIGS. 7–9, a second method of the invention is for printing and includes steps a) through e). Step a) is labeled as "Obtain Printer" in block 56 of FIG. 7. Step a) includes obtaining a printer having a carrier which is horizontally movable across a print medium and having two horizontally-spaced-apart printheads attached to the carrier, wherein the printer has a resolution using a single printhead of H horizontally-spaced-apart dots-per-inch by V vertically-spaced-apart dots-per-inch. Step b) is labeled as "Obtain First Print Data" in block 58 of FIG. 7. Step b) includes obtaining first print data for the first printhead of H/2 horizontally-spaced-apart dots-per-inch by V vertically-spaced-apart dots-per-inch. Step c) is labeled as "Obtain Second Print Data" in block 60 of FIG. 7. Step c) includes obtaining second print data for the second printhead of H/2 horizontally-spaced-apart dots-per-inch by V vertically-spaced-apart dots-per-inch. Step d) is labeled as "Interlace First And Second Print Data" in block 62 of FIG. 7. Step d) includes horizontally interlacing the first and second print data creating interlaced print data of H horizontally-spaced-apart dots-per-inch by V vertically-spaced-apart dots-per-inch. Step e) is labeled as "Print Dots" in block 64 of FIG. 7. Step e) includes printing dots on the print medium corresponding to the interlaced print data using the first and second printheads as the carrier moves horizontally across the print medium in the same print pass. It is noted that the term "interlacing" simply means combining and that examples of horizontally interlacing are described below.

In one execution of the second method, the first printhead is an ink-jet color printhead, and the second printhead is an inkjet mono printhead or an ink-jet photo printhead. In one variation, the color printhead prints cyan dots, magenta dots and yellow dots, the mono printhead prints black dots, and the photo printhead prints black dots, cyan dots and magenta dots.

In one example of the second method, the first and second print data correspond to print data of a single-pass print swath. In a different example, the first and second print data correspond to one pass of a multi-pass print swath.

In a first illustration of the second method, the first printhead has a first nozzle array of vertically-spaced-apart print nozzles, the second printhead has a second nozzle array of vertically-spaced-apart print nozzles, and the first nozzle array is horizontally aligned with the second nozzle array.

In one variation of the first illustration, the first and second print data correspond to print data of a single-pass print swath, and the interlaced print data includes a row and column pixel array wherein odd-numbered columns of the pixel array are print data for the first printhead and even-numbered columns of the pixel array are print data for the second printhead. In one modification, H equals V equals 600. This is depicted in FIG. 8, wherein dots printed on a print medium by a single-pass print swath are shown, wherein dots (shown as squares) labeled "1" were printed by the first printhead and dots labeled "2" were printed by the second printhead. The term "printed" used in describing FIGS. 8 and 9 includes inked dots and blank dots, as is understood by the artisan. It is noted that the carrier can move at a higher speed because each printhead is only fired every 1/300 of an inch. Only dots printed by the top four inkjet nozzles of each printhead (assuming the printheads are ink-jet printheads) are shown in FIG. 8. The paper is vertically advanced between print swaths.

In another variation of the first illustration, the first and second print data correspond to one pass of a four-pass (shingling) print swath, and the interlaced print data includes a row and column pixel array. The paper is advanced only between print swaths (i.e., after the fourth pass). The odd-numbered nozzles of the first nozzle array print pixels in the first, fifth, ninth, et seq. columns of the pixel array and the odd-numbered nozzles of the second nozzle array print pixels in the third, seventh, eleventh, et seq. columns of the pixel array during the first print pass. This is depicted in FIG. 9, wherein dots (shown as squares) printed on a print medium during a first print pass of the carrier across the print medium are labeled "1-1" if printed by the first printhead and are labeled "1-2" if printed by the second printhead. The even-numbered nozzles of the second nozzle array print pixels in the first, fifth, ninth, et seq. columns of the pixel array and the even-numbered nozzles of the first nozzle array print pixels in the third, seventh, eleventh, et seq. columns of the pixel array during the second print pass. This is depicted in FIG. 9, wherein dots printed during a second print pass are labeled "2-1" if printed by the first printhead and are labeled "2-2" if printed by the second printhead. The odd-numbered nozzles of the second nozzle array print pixels in the second, sixth, tenth, et seq. columns of the pixel array and the odd-numbered nozzles of the first nozzle array print pixels in the fourth, eighth, twelfth, et seq. columns of the pixel array during the third print pass. This is depicted in FIG. 9, wherein dots printed during a third print pass are labeled "3-1" if printed by the first printhead and are labeled "3-2" is printed by the second printhead. The even-numbered nozzles of the first nozzle array print pixels in the second, sixth, tenth, et seq. columns of the pixel array, and the even-numbered nozzles of the second nozzle array print pixels in the fourth, eighth, twelfth, et seq. columns of the pixel array during the fourth print pass. This is depicted in FIG. 9, wherein dots printed during a fourth print pass are labeled "4-1" if printed by the first printhead and are labeled "4-2" if printed by the second printhead. Only dots printed by the top four inkjet nozzles of each printhead (assuming the printheads are ink-jet printheads) are shown in FIG. 9. In one variation, H equals V equals 600.

Several benefits and advantages are derived from one or more of the methods and the expressions of an embodiment of the invention. Printing using two printheads in the same print pass can be accomplished by the first method and by the second method using a single printhead driver with less memory, lower power, and lower cost compared to conventional methods which require using two printhead drivers.

The foregoing description of several methods and several expressions of an embodiment of the invention has been presented for purposes of illustration. It is not intended to be exhaustive or to limit the invention to the precise procedures and forms disclosed, and obviously many modifications and variations are possible in light of the above teaching. It is intended that the scope of the invention be defined by the claims appended hereto.

What is claimed is:

1. A method for printing comprising the steps of:

a) obtaining a printer including a carrier which is horizontally movable across a print medium, including first and second printheads attached to the carrier, and including a printhead driver connected to the first and second printheads, wherein the printer has a horizontal resolution using a single printhead of H horizontally-spaced-apart dots-per-inch; and b) printing dots on the print medium in a first printing mode using the first and second printheads as the carrier moves horizontally across the print medium in the same print pass, wherein the first printhead is enabled and the second printhead is non-enabled by the printhead driver during a first portion of a carrier-movement distance equal to 1/H, wherein the second printhead is enabled and the first printhead is non-enabled by the printhead driver during a second portion of the carrier-movement distance, and wherein the first and second portions do not overlap.

2. The method of claim 1, wherein H equals 600 dots per inch.

3. The method of claim 1, also including the step of:

c) printing additional dots in a second printing mode using only the first printhead, wherein the second printhead is non-enabled by the printhead driver during the entire carrier-movement distance.

4. The method of claim 3, wherein step c) prints dots in the second printing mode as the carrier moves across the print medium in a second print pass, and also including the step of advancing the print medium between step b) and step c).

5. The method of claim 3, also including the step of printing other dots in a third printing mode using only the second printhead, wherein the first printhead is non-enabled by the printhead driver during the entire carrier-movement distance.

6. The method of claim 1, wherein the first printhead is an inkjet color printhead, and wherein the second printhead is an inkjet mono printhead or an inkjet photo printhead.

7. The method of claim 6, wherein the color printhead prints cyan dots, magenta dots and yellow dots, wherein the mono printhead prints black dots, and wherein the photo printhead prints black dots, cyan dots and magenta dots.

8. A printer comprising:

a) a carrier which is horizontally movable across a print medium;

b) first and second printheads attached to the carrier; and b) a printhead driver connected to the first and second printheads, wherein the printer has a horizontal resolution using a single printhead of H horizontally-spaced-apart dots-per-inch, wherein the printhead driver has a first printing mode which enables the first printhead and non-enables the second printhead during a first portion of a carrier-movement distance equal to 1/H and which, enables the second printhead and non-enables the first printhead during a second portion of the carrier-movement distance, and wherein the first and second portions do not overlap.

9. The printer of claim 8, wherein the printhead driver also has a second printing mode which enables the first printhead during the carrier-movement distance and which non-enables the second printhead during the entire carrier-movement distance.

10. The printer of claim 9, wherein the printhead driver also has a third printing mode which enables the second printhead during the carrier-movement distance and which non-enables the first printhead during the entire carrier-movement distance.

11. A printer comprising:

a) a carrier which is horizontally movable across a print medium;

b) first and second printheads attached to the carrier; and b) a printhead driver connected to the first and second printheads, wherein the printer has a horizontal resolution using a single printhead of H horizontally-spaced-apart dots-per-inch, wherein the printhead driver has a first printing mode which enables the first printhead and non-enables the second printhead during a first portion of a carrier-movement distance equal to 1/H and which enables the second printhead and non-enables the first printhead during a second portion of the carrier-movement distance, wherein the first and second portions do not overlap, wherein the printhead driver also has a second printing mode which enables the first printhead during the carrier-movement distance and which non-enables the second printhead during the entire carrier-movement distance, wherein the printhead driver also has a third printing mode which enables the second printhead during the carrier-movement distance and which non-enables the first printhead during the entire carrier-movement distance, wherein the printhead driver includes first, second and third printhead select pins, wherein the first printhead select pin is connected to the first printhead, and wherein the second and third printhead select pins are coupled to the second printhead in a logical OR connection.

12. The printer of claim 11, wherein in the first printing mode the printhead driver always creates a non-enable signal on the third printhead select pin, and wherein in the second and third printing modes the printhead driver always creates a non-enable signal on the second printhead select pin.

13. The printer of claim 12, wherein the first printhead is an inkjet color printhead, and wherein the second printhead is an inkjet mono printhead or an inkjet photo printhead.

14. The printer of claim 13, wherein the color printhead prints cyan dots, magenta dots and yellow dots, wherein the mono printhead prints black dots, and wherein the photo printhead prints black dots, cyan dots and magenta dots.

15. A printhead driver comprising:

a) first, second and third printhead select pins;

b) printer-driver logic which creates an enable or a non-enable signal on each of the first, second and third printhead select pins; and c) a printhead connect line, wherein the first printhead select pin is connectable to a first printhead of a movable carrier, wherein the second and third printhead select pins are coupled to the printhead connect line in a logical OR connection, and wherein the printhead connect line is connectable to a second printhead of the carrier.

16. A method for printing comprising the steps of:

a) obtaining a printer including a carrier which is horizontally movable across a print medium and including two horizontally-spaced-apart printheads attached to the carrier, wherein the printer has a resolution using a single printhead of H horizontally-spaced-apart dots-per-inch by V vertically-spaced-apart dots-per-inch;

b) obtaining first print data for the first printhead of H/2 horizontally-Spaced-apart dots-per-inch by V vertically-spaced-apart dots-per-inch;

c) obtaining second print data for the second printhead of H/2 horizontally-spaced-apart dots-per-inch by V vertically-spaced-apart dots-per-inch;

d) horizontally interlacing the first and second print data creating interlaced print data of H horizontally-spaced-apart dots-per-inch by V vertically-spaced-apart dots-per-inch; and e) printing dots on the print medium corresponding to the interlaced print data using the first and second printheads as the carrier moves horizontally across the print medium in the same print pass.

17. The method of claim 16, wherein the first printhead is an inkjet color printhead, and wherein the second printhead is an inkjet mono printhead or an inkjet photo printhead.

18. The method of claim 17, wherein the color printhead prints cyan dots, magenta dots and yellow dots, wherein the mono printhead prints black dots, and wherein the photo printhead prints black dots, cyan dots and magenta dots.

19. The method of claim 16, wherein the first and second print data correspond to print data of a single-pass print swath.

20. The method of claim 16, wherein the first and second print data correspond to one pass of a multi-pass print swath.

21. The method of claim 16, wherein the first printhead has a first nozzle array of vertically-spaced-apart print nozzles, wherein the second printhead has a second nozzle array of vertically-spaced-apart print nozzles, and wherein the first nozzle array is horizontally aligned with the second nozzle array.

22. The method of claim 21, wherein the first and second print data correspond to print data of a single-pass print swath, and wherein the interlaced print data includes a row and column pixel array wherein odd-numbered columns of the pixel array are print data for the first printhead and even-numbered columns of the pixel array are print data for the second printhead.

23. The method of claim 22, wherein H equals V equals 600.

24. The method of claim 21, wherein the first and second print data correspond to one pass of a four-pass print swath, and wherein the interlaced print data includes a row and column pixel array.

25. The method of claim 24, wherein the odd-numbered nozzles of the first nozzle array print pixels in the first, fifth, ninth, et seq. columns of the pixel array and the odd-numbered nozzles of the second nozzle array print pixels in the third, seventh, eleventh, et seq. columns of the pixel array during the first print pass.

26. The method of claim 25, wherein the even-numbered nozzles of the second nozzle array print pixels in the first, fifth, ninth, et seq. columns of the pixel array and the even-numbered nozzles of the first nozzle array print pixels in the third, seventh, eleventh, et seq. columns of the pixel array during the second print pass.

27. The method of claim 26, wherein the odd-numbered nozzles of the second nozzle array print pixels in the second, sixth, tenth, et seq. columns of the pixel array and the odd-numbered nozzles of the first nozzle array print pixels in the fourth, eighth, twelfth, et seq. columns of the pixel array during the third print pass.

28. The method of claim 27, wherein the even-numbered nozzles of the first nozzle array print pixels in the second, sixth, tenth, et seq. columns of the pixel array and the even-numbered nozzles of the second nozzle array print pixels in the fourth, eighth, twelfth, et seq. columns of the pixel array during the fourth print pass.

29. The method of claim 28, wherein H equals V equals 600.

* * * * *